US007036830B2

(12) United States Patent
Gonthier

(10) Patent No.: US 7,036,830 B2
(45) Date of Patent: May 2, 2006

(54) BINDING FOR RETAINING A BOOT ON A GLIDING OR ROLLING APPARATUS

(75) Inventor: Jean-François Gonthier, Viuz la Chiesaz (FR)

(73) Assignee: Salomon S.A., Metz-Tessy (FR)

( * ) Notice: Subject to any disclaimer, the term of this patent is extended or adjusted under 35 U.S.C. 154(b) by 0 days.

(21) Appl. No.: 10/787,210

(22) Filed: Feb. 27, 2004

(65) Prior Publication Data

US 2004/0164522 A1 Aug. 26, 2004

Related U.S. Application Data

(63) Continuation of application No. 09/835,638, filed on Apr. 17, 2001, now Pat. No. 6,773,020.

(30) Foreign Application Priority Data

Apr. 18, 2000 (FR) ..... 00 05262

(51) Int. Cl.
*A63C 5/00* (2006.01)

(52) U.S. Cl. ..... 280/14.21; 280/623; 280/619; 280/14.22

(58) Field of Classification Search ..... 280/623, 280/607, 611, 617, 618, 633, 635, 636, 619, 280/622, 634, 637, 14.21, 14.22; 441/70; 24/70 SK See application file for complete search history.

(56) References Cited

U.S. PATENT DOCUMENTS

| | | | | |
|---|---|---|---|---|
| 5,609,347 | A * | 3/1997 | Dressel | 280/14.23 |
| 5,758,895 | A * | 6/1998 | Bumgarner | 280/607 |
| 5,765,853 | A * | 6/1998 | Erb | 280/607 |
| 5,782,476 | A * | 7/1998 | Fardie | 280/14.24 |
| 6,250,651 | B1 * | 6/2001 | Reuss et al. | 280/14.21 |
| 6,390,492 | B1 * | 5/2002 | Bumgarner et al. | 280/607 |
| 2002/0084604 | A1 * | 7/2002 | Phillips et al. | 280/14.21 |

FOREIGN PATENT DOCUMENTS

| | | |
|---|---|---|
| EP | 0958846 | 11/1999 |
| FR | 2774302 | 8/1999 |

* cited by examiner

*Primary Examiner*—J. Allen Shriver
(74) *Attorney, Agent, or Firm*—Greenblum & Bernstein, P.L.C.

(57) ABSTRACT

A binding to retain a boot on a gliding or rolling apparatus, such as a snowboard, ski, or roller skate. The binding includes a linkage that connects first and second flanges. The linkage includes a first band attached to the first flange, and a tightening device attached to the second flange. An abutment of the binding is fixed to the first band toward a free end of the band, so as to be located on the other side of the tightening device with respect to a fastening end of the band, thus preventing a separation of the first band and of the tightening device.

22 Claims, 4 Drawing Sheets

BINDING FOR RETAINING A BOOT ON A GLIDING OR ROLLING APPARATUS

CROSS-REFERENCE TO RELATED APPLICATIONS

This application is a continuation of U.S. patent application Ser. No. 09/835,638, filed on Apr. 17, 2001, now U.S. Pat. No. 6,773,020 the disclosure of which is hereby incorporated-by-reference thereto in its entirety and the priority of which is claimed under 35 U.S.C. §120.

This application also claims priority, under 35 U.S.C. §119, of French Patent Application No. 00.05262, filed Apr. 18, 2000, the disclosure of which is hereby incorporated by reference thereto in its entirety.

BACKGROUND OF THE INVENTION

1. Field of the Invention

The present invention relates to the field of bindings adapted to retain a boot on a gliding or rolling apparatus, such as a ski, a snowboard, a roller skate, or the like.

2. Description of Background and Relevant Information

Generally speaking, when a user wears flexible boots to operate the apparatus, whether it be a ski, snowboard, or roller skate, e.g., each boot is retained by a binding provided with one or more linkages, such as one or more straps with buckles.

To be able to put on or remove the boot, i.e., to affix the boot to the binding, or to remove it therefrom, each linkage can be opened or closed. Moreover, the length of the linkage can be adjusted.

In general, a linkage includes two bands each attached on a respective side of the binding, as well as a device for tightening the linkage. A manual action on a button, buckle, lever or other member of the device enables the linkage to be opened.

Closing the linkage requires the user to adjust the position of a band with respect to the tightening device, then to introduce the band into the device, and then to reduce the length of the linkage, in particular by means of a lever for driving the band located on the device. To do this, the user generally needs to bend his/her body and lower limbs, and to use both hands.

Therefore, closing the linkage can be an arduous task and a waste of time for the user.

SUMMARY OF THE INVENTION

An object of the present invention in particular is to make it easier and quicker to fit a binding provided with linkages.

To this end, a binding adapted to retain a boot on a gliding or rolling apparatus, according to the invention, includes a first lateral flange, a second lateral flange, and at least one linkage connecting the first flange to the second flange, the linkage including a first band that extends from one fastening end to one free end, the fastening end being attached to the first flange, the linkage further including a tightening device attached to the second flange, the tightening device making it possible to adjust the length of the linkage by retaining a portion of the first band in a removable fashion.

An abutment of the binding according to the invention is fixed to the first band toward the free end of the band, so as to be located on the other side of the tightening device with respect to the fastening end of the band, thus preventing a separation of the first band and of the tightening device.

As a result, the user does not have to adjust the position of the band with respect to the tightening device, then to introduce the band into the device. He/She must only adjust the length of the linkage, which can be done with only one hand.

Advantageously, the result is that closing the linkage is easy and quick.

BRIEF DESCRIPTION OF DRAWINGS

Other characteristics and advantages of the invention will be better understood from the description that follows, with reference to the annexed drawings showing, by way of non-limiting examples, how the invention can be embodied, and in which.

DETAILED DESCRIPTION OF THE INVENTION

The examples described hereinafter correspond to an application in the field of snowboards.

Figure 1:
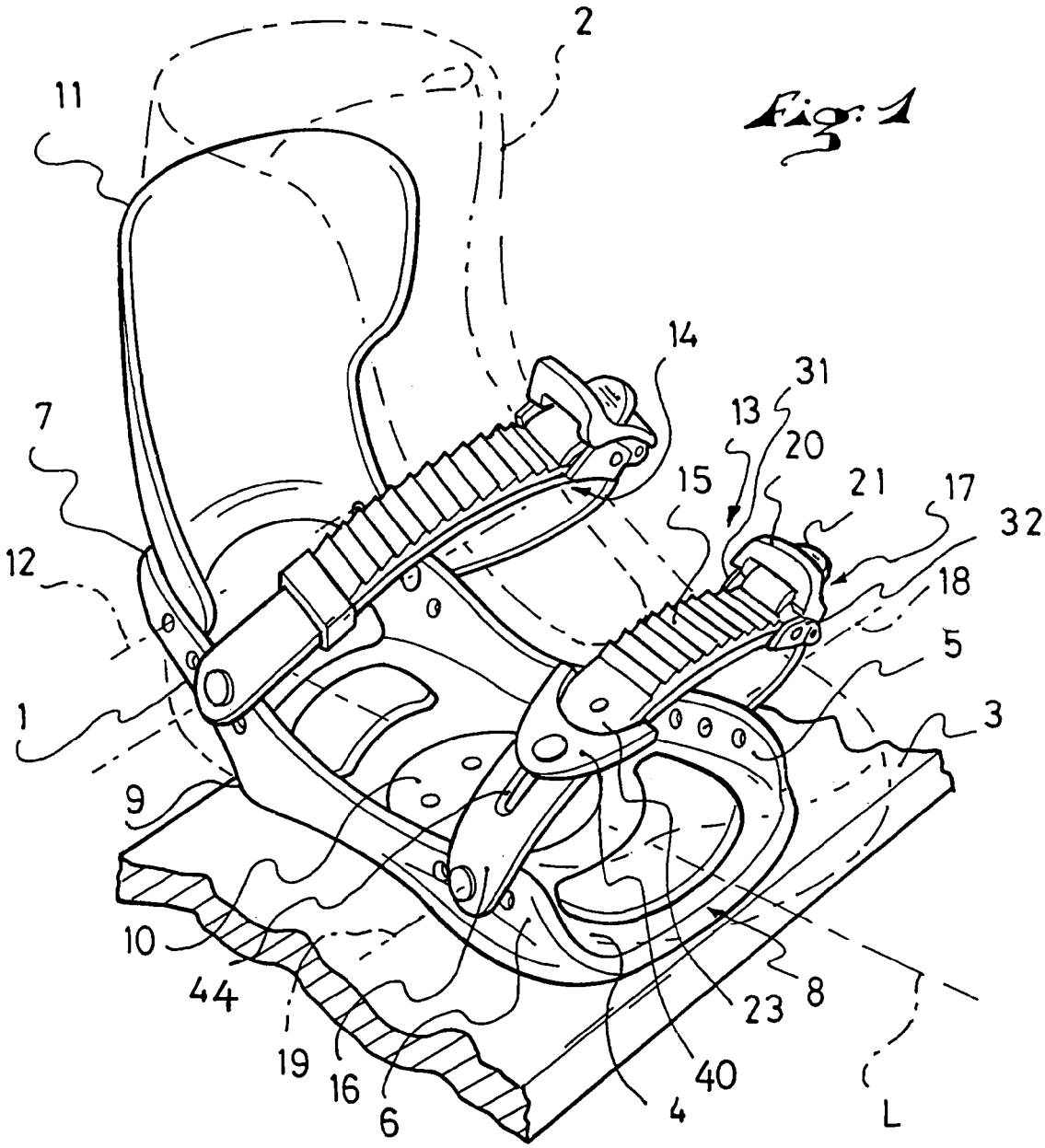
FIG. 1 is a perspective view of a binding, in a case where a boot is retained, according to a first embodiment of the invention.

According to the first example, as seen in FIG. 1, a binding 1 retains a boot 2 on a board 3.

In a known manner, the binding 1 includes a base 4 on which a first lateral flange 5 and a second lateral flange 6 are attached, the flanges 5, 6 being transversely spaced apart and connected by an arch 7.

The base 4 extends, along a longitudinal direction L of the binding 1, between a front end 8 and a rear end 9 of the base.

Affixing the binding 1 to the board 3 is done by a means shown in the form of a disc 10.

A rear support element 11, provided to retain the rear of the user's lower leg, is attached on the binding 1, for example, by means of a journal axis 12 on the flanges 5, 6.

The binding 1 also includes a front linkage 13 and a rear linkage 14, each shown in a position for retaining the boot 2 in FIG. 1.

For reasons of convenience and for facilitating an understanding of the invention, only one of the linkages is described hereinafter in more detail.

For example, the front linkage 13 includes in particular a first band 15, a second band 16, and a tightening device 17 making it possible to adjust the length of the linkage.

The first band 15 is attached to the first flange 5, by a means shown in the form of a journal axis 18. By analogy, the second band 16 is attached to the second flange 6, by a means shown in the form of a journal member positioned along axis 19.

The connection of the first band 15 to the second band 16 is done by a tightening device 17 which, to this end, includes in particular a drive lever 20 and a button 21 for releasing the first band 15.

As the tightening device 17 is fixed to the second band 16, by any suitable means, the lever 20 and button 21 make it possible to adjust the length of the linkage 13 by displacing one band with respect to the other.

The structure and functioning of the linkages are explained hereinafter in more detail by means of FIGS. 2–4.

Figure 2:
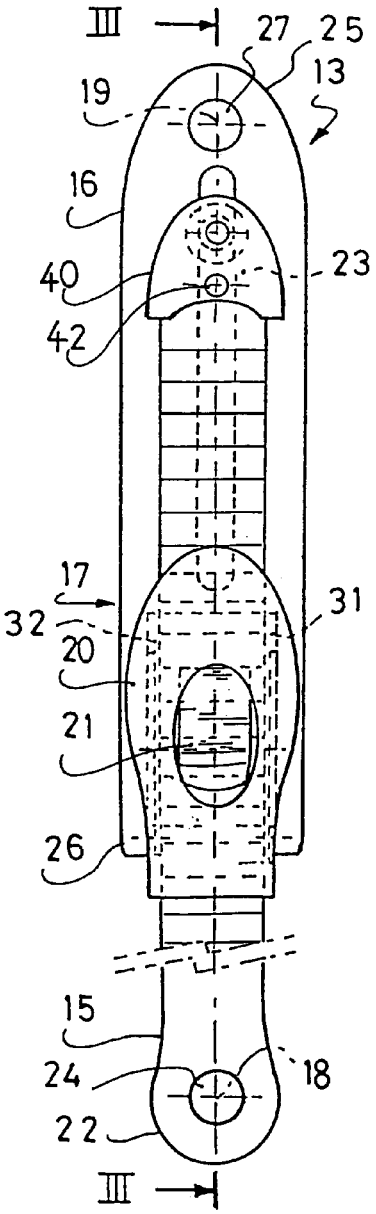
FIG. 2 schematically shows a view of a linkage of the binding, in a case where the length of the linkage is reduced.

The front linkage 13 is schematically shown in FIG. 2, in a top view, in a case where its length is reduced. This means that the first 15 and second 16 bands are superimposed over a substantial distance.

The first band 15 extends between a fastening end 22 and a free end 23. An opening 24, provided in the fastening end 22, enables the passage of a fastening means or fastener, such as a rivet or other journal connection, to provide the journal member at axis 18.

By analogy, the second band 16 extends between a fastening end 25 and a free end 26. An opening 27, provided in the fastening end 25, enables the passage of a fastening means or fastener, such as a rivet or other journal connection, to provide the journal member at axis 19.

Also, as shown in the drawings, FIG. 2 in particular, between the opening 24 of the fastening end of the first band 16 and the opening 27 of the fastening end 25 of the second band, the first and second bands 15, 16 extend along a straight line III—III prior to assembly to the lateral flanges 5, 6. Stated another way, between their respective pairs of ends 22, 23 and 25, 26, the first and second bands 15, 16, before or after attachment to the lateral flanges 5, 6, extend along a common median plane, as shown in FIG. 2.

Figure 3:
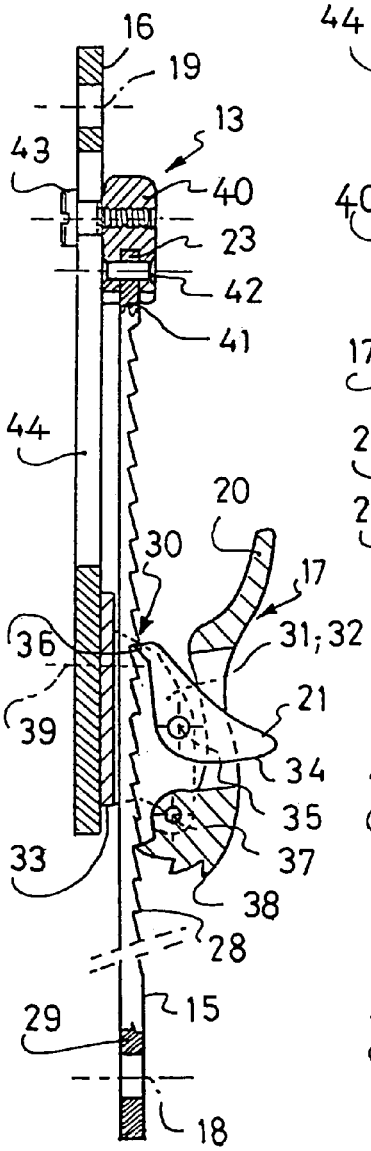
FIG. 3 is a cross-section taken along the line III—III of FIG. 2.

FIG. 3 discloses the internal structure of the linkage 13.

The first band 15 is obtained in the form of a rack, whose teeth 28 and core 29 preferably form a unitary piece.

The tightening device 17 has a passage 30 for guiding the band 15. The passage 30 is formed in particular by two wings 31, 32 connected by a bridge 33. A pawl 34 is journaled between the wings along an axis 35. The pawl 34 has a retaining end 36, provided to oppose a lengthening of the linkage 13 by engagement of the retaining end 36 with an abutment formed by a tooth 28, and an end forming a release button 21 to allow disengagement of the retaining end 36 with the abutting tooth. The end 36 is constantly biased toward the bridge 33 by an elastic means, not shown, such as a spring.

The drive lever 20 is journaled between the wings 31, 32 along an axis 37. It has at least one tooth 38 for driving the first band 15 in a shortening direction of the linkage 13.

An elastic member or mechanism (not shown for sake of simplicity), such as a spring, constantly biases the lever 20 such that the teeth 38 move away from the bridge 33.

The tightening device 17 is fixed to the second band 16, for example, by means of a rivet having an axis 39.

According to the invention, an abutment 40 is fixed to the first band 15, so as to enable an extension of the linkage to a maximum length, and to prevent a separation of the first band 15 and of the tightening device 17.

Preferably, the abutment 40 is fixed to the free end 23 of the band 15, for example, by a nesting of the band 15 in a cutout 41 of the abutment 40, combined to a retaining element shown in the form of a rivet 42 that extends through the band 15 and the cutout 41.

Complementarily, the abutment 40 is guided along the second band 16, by a guide shown in the form of a screw 43 which extends through a longitudinal slot 44 of the second band 16.

The screw 43 is screwed into the abutment 40. The screw 43 has a head whose diameter is greater than the width of the slot 44.

As a result, the two bands of a same linkage slide parallel to one another when the linkage is extended or shortened.

Figure 4:
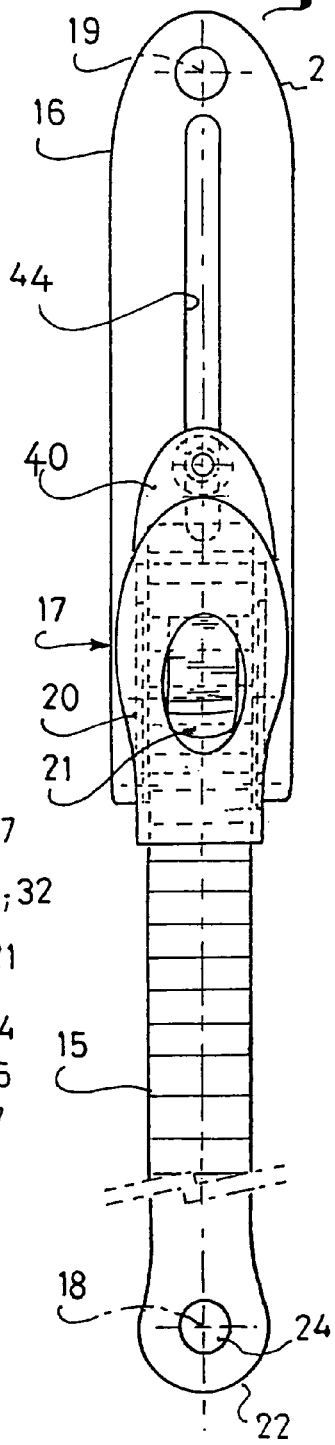
FIG. 4 is similar to FIG. 2, in a case where the length of the linkage is substantial.

When the linkage has a maximum length, as is the case in FIG. 4, the abutment 40 is in support on the wings 31, 32, of the tightening device 17.

Indeed, the abutment 40 cannot pass in the passage 30, because its width is greater than the distance that separates the wings 31, 32. As a result, the bands cannot separate.

When the user wishes to shorten the linkage, he/she only needs, for example, to act on the drive lever 20.

Figure 5:
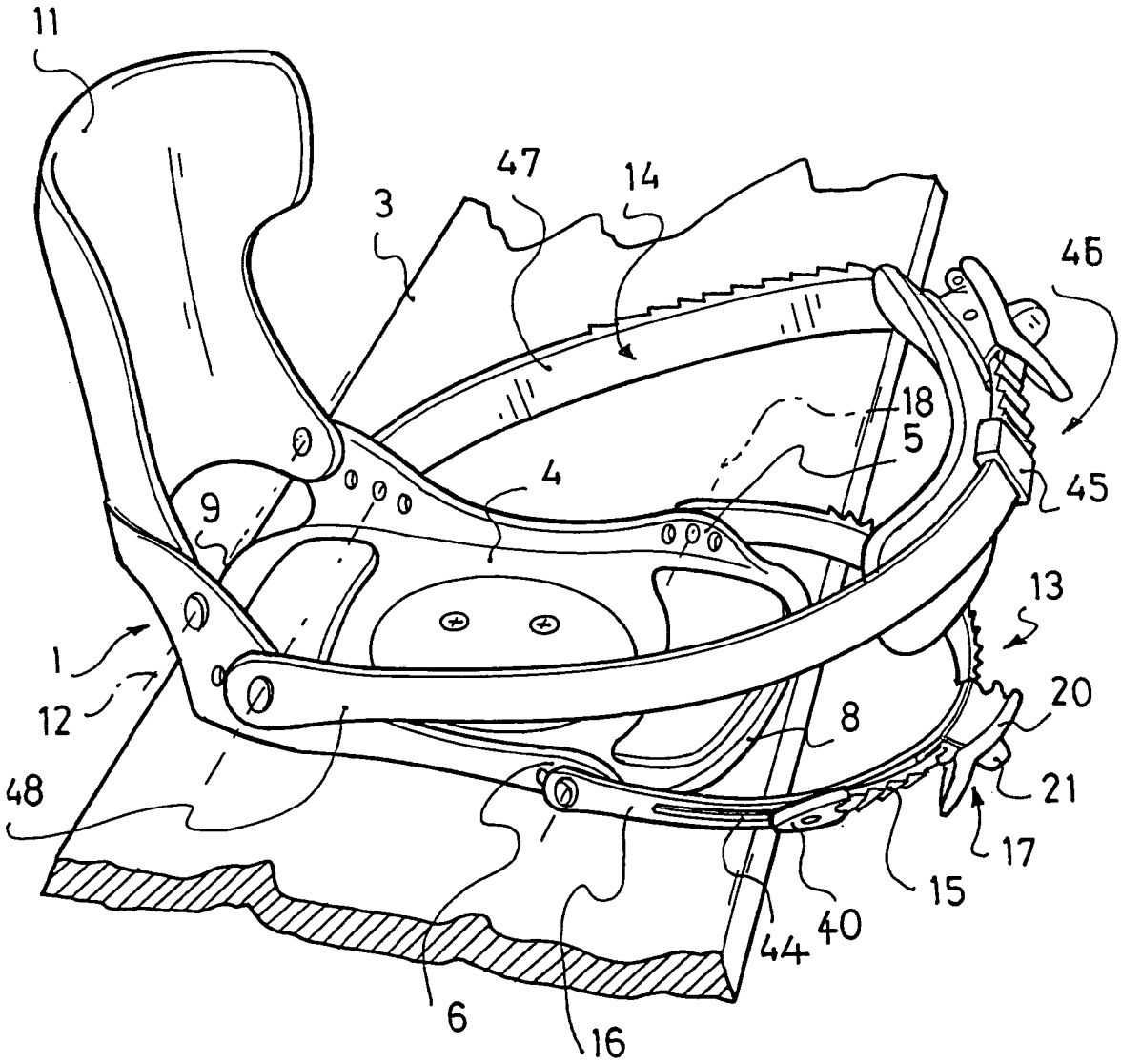
FIG. 5 is a view similar to FIG. 1, in a case where the boot is not retained.

This structure of the linkage enables the user to remove the boot, as shown in FIG. 5.

Each of the linkages 13, 14 is lengthened by a manual action from the user, so as to leave a space between the boot and the linkage. When each space is large enough, the boot can be removed from the binding. Given that the straps of the linkages are journalled on the flanges 5, 6 of the binding 1, it is possible to tilt the linkages 13, 14 toward the front of the binding. In the case of the front linkage 13, the tilting is done rotationally along the axes 18, 19. After tilting, such as shown by the front linkage 13 in FIG. 5, the linkages are positioned to extend substantially along a plane parallel to the base 4, that is, along a plane positioned substantially 0° relative to the plane of the upper surface of the base.

Advantageously, the result is that the operations of putting on and removing the boot are made easier, because nothing hinders the movement of the boot into the binding or movement of the boot from the binding. As can be seen in FIG. 5, the two bands 15, 16 of the linkage 13 extend longitudinally along a common plane, the plane intersecting with the fasteners that fasten the linkage to the lateral flanges 5, 6, so that the linkage 13 can assume a flat unrestrained position so that the rider's boot can be readily inserted into, or removed from, the binding.

Preferably, the length of each of the front 13 and rear 14 linkages is such that when it is tilted toward the front of the binding 1, it goes around the front end of the boot 2, if the latter is in position on the base 4 and in contact with the arch 7.

For example, the front linkage 13 can have a maximum length between about 25 centimeters and 50 centimeters, and the rear linkage 14 can have a maximum length between about 45 centimeters and 85 centimeters.

These lengths enable the linkages to go around the boot in the plane of the sole. As a result, the linkages do not create any hindrance when the boot is put on or removed.

The other embodiments of the invention are presented hereinafter.

For reasons of convenience, only the differences with respect to the first example will be shown.

Figure 6:
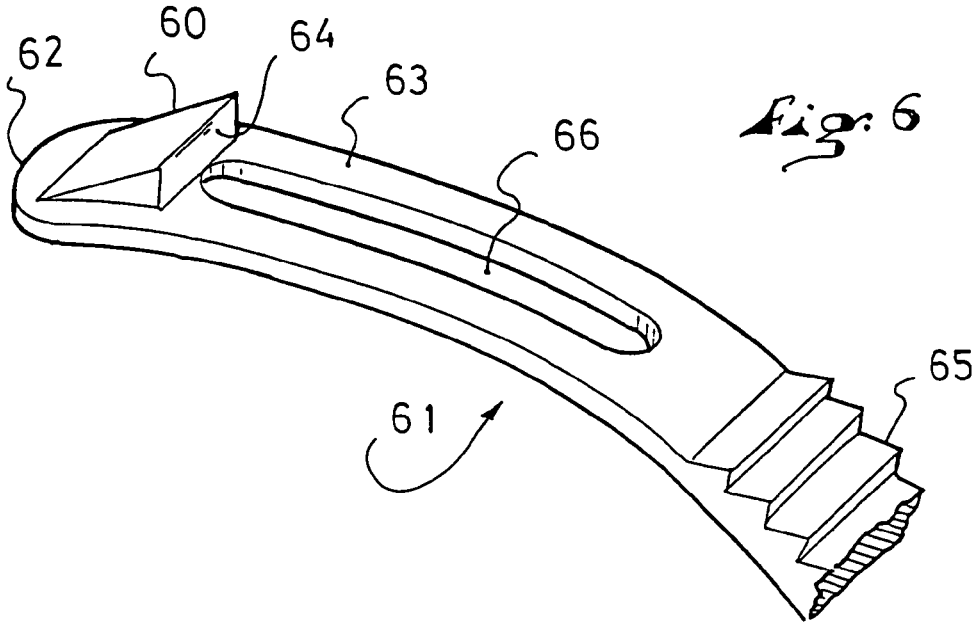
FIG. 6 is a partial view of the first band of a linkage of the binding, according to a second embodiment of the invention.

According to the second example, as seen in FIG. 6, an abutment 60 is fixed to the first band 61 of a linkage toward the free end 62 of the band 61. The abutment 60 and the first band 61 are shown in the form of a unitary piece. The binding of the abutment 60 to the band 61 is a broad expression meaning that the abutment and the band are affixed to one another.

The abutment 60 projects with respect to an outer surface 63 of the band, the outer surface 63 facing away from the base of the binding and the boot, whereas the opposite, inner, surface faces toward the boot, i.e., toward the base of the binding. The abutment 60 is shown in the form of a wedge whose surface 64, substantially perpendicular to the surface 63, is turned toward the rack 65 of the band 61 and facing longitudinally of the band toward the tightening device. The surface 64 takes support on the pawl to avoid an opening of the linkage, because the surface 64 is higher than the teeth of the rack 65.

The band 61 preferably has a longitudinal slot 66.

Figure 7:
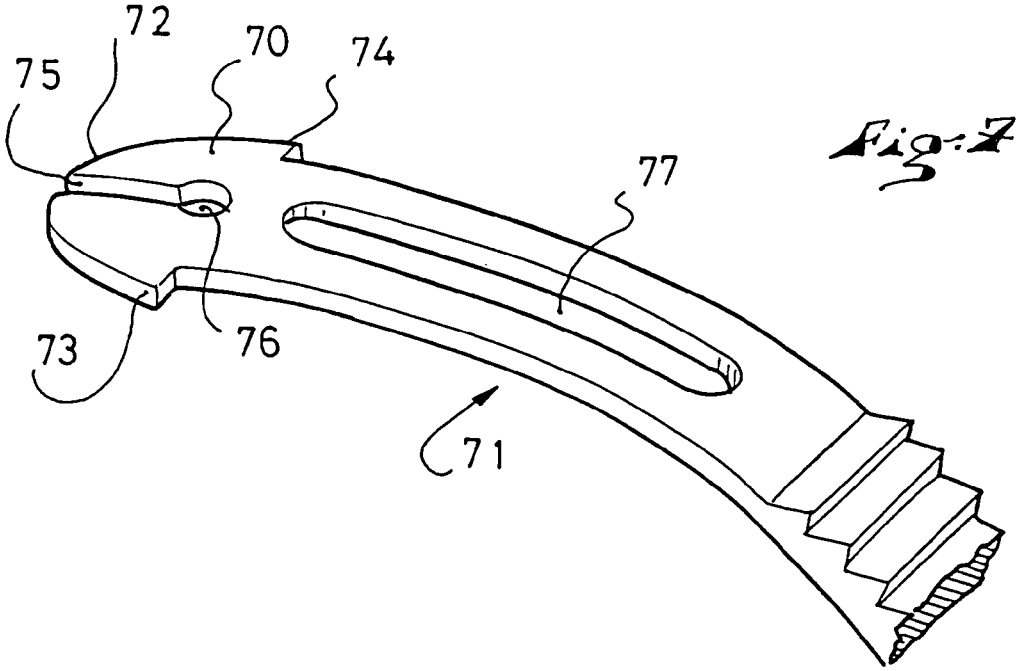
FIG. 7 is a partial view of the first band of a linkage of the binding, according to a third embodiment of the invention.

According to the third example, as seen in FIG. 7, an abutment 70 is fixed to the first band 71 of a linkage toward the free end 72 of the band 71. The abutment 70 and the first band 71 are shown in the form of a unitary piece.

The abutment 70 is shaped like an arrow head, i.e., it has a longitudinally tapered shape, narrowing to the free end of the band 71, the shape including includes two lateral teeth 73, 74 separated at least partially by a slot 75, which is open at the free end of the band.

The teeth 73, 74 prevent an opening of the linkage by taking support on the wings of the tightening device.

The slot 75 enables the teeth 73, 74 to come close together, under the action of an external force, for the mounting or dismounting of the linkage. A hole 76, at the end of the slot 75, prevents the appearance of incipient fractures in the first band 71.

The band 71 preferably has a longitudinal slot 77.

The invention is not limited to the examples described hereinabove, and it includes all of the technical equivalents that fall within the scope of the claims that follow.

In particular, the abutment 40 could be obtained in a different manner. As seen in FIG. 5 in the case of the rear linkage 14, the abutment is obtained in the form of a guide 45 fixed to the free end 46 of a first band 47. The guide is large enough to play its role of an abutment; but at the same time, it enables the guiding of the free end along a second band 48 of the rear linkage 14. In this case, the second band 48 has a continuous width.

The device for tightening the first band could have a different structure. Supplemental layers can be added to the linkage, in particular to ensure functions of protection and ease of use.

Furthermore, a linkage could include only one band and one tightening device. In this case, the tightening device is attached directly to a flange of the binding.

Conversely, a linkage could include more than two bands.

Still, the binding may not include the base, the flanges being in this case directly affixed to the board.

Finally, although the examples have been described for an application in the field of snowboards, the binding according to the invention can be used in other fields such as skis, snowshoes, or the like.

What is claimed is:

1. A binding to retain a boot on a gliding or rolling apparatus, said binding comprising:

a base for supporting the boot, said base including an upper surface extending along a plane;

a first lateral flange, a second lateral flange transversely spaced from said first lateral flange, said first and second lateral flanges extending upwardly relative to said surface of said base;

at least one linkage connecting said first lateral flange to said second lateral flange, said linkage comprising:

a first band extending from one fastening end to a free end, a first fastener attaching said fastening end of said first band to said first lateral flange;

a tightening device attached to said second lateral flange, said tightening device facilitating an adjustment of a length of said linkage by removably retaining a portion of said first band;

an abutment fixed to said first band, said tightening device being positioned between the abutment and said fastening end of said first band, thereby preventing separation of said first band and said tightening device;

at least one linkage of said at least one linkage being movable relative to said first and second lateral flanges to a boot removal/insertion position extending along a plane positioned at substantially 0° relative to said plane of the upper surface of said base.

2. A binding according to claim 1, wherein:

said tightening device has a passage for guiding said first band, said abutment being wider than said passage.

3. A binding according to claim 1, further comprising:

a rear arch for supporting a rear of the boot, said rear arch connecting said first and second lateral flanges, wherein a length of each of said at least one linkage is constructed and arranged so that, when said each of said at least one linkage is forwardly positioned, each of said at least one linkage extends around a front of the boot when the boot is supported on said base plate and in contact with said rear arch.

4. A binding according to claim 3, wherein:

said at least one linkage includes a front linkage having a length within a range of about 25 to 50 centimeters.

5. A binding according to claim 3, wherein:

said at least one linkage includes a rear linkage having a length within a range of about 45 to 85 centimeters.

6. A binding according to claim 1, further comprising:

a second fastener;

said linkage including a second band, said second fastener attaching said second band to said second lateral flange, said tightening device being fixed to said second band.

7. A binding according to claim 6, wherein:

said first and second lateral flanges are attached to said base.

8. A binding according to claim 7, wherein:

said tightening device has a passage for guiding said first band, said abutment being wider than said passage.

9. A binding according to claim 6, wherein:

said tightening device has a passage for guiding said first band, said abutment being wider than said passage.

10. A binding according to claim 6, wherein:

said first and second fasteners of each linkage are journals.

11. A binding according to claim 10, wherein:

one guide guides said abutment along said second band.

12. A binding according to claim 6, wherein:

one guide guides said abutment along said second band.

13. A binding according to claim 6, wherein:

said first and second fasteners constitute first and second journal connections;

said one linkage of said at least one linkage is pivotal about said first and second journal connections to said position substantially 0° relative to said plane of said base.

14. A binding according to claim 6, wherein:

said first fastener extends from said first band to said first lateral flange and said second fastener extends from said second band to said second lateral flange.

15. A binding according to claim 6, wherein:

said free end of said first band has a longitudinally tapered shape, and said abutment comprises a pair of lateral teeth.

16. A binding to retain a boot on a gliding or rolling apparatus, said binding comprising:

a first lateral flange, a second lateral flange transversely spaced from said first lateral flange;

at least one linkage extending from said first flange to said second flange, said one linkage comprising:

a first band extending from a fastening end to a free end having a longitudinally tapered width, said fastening end of said first band being directly attached to said first lateral flange by means of a first fastener, said free end of said first band having a longitudinally tapered shape;

a second band having a fastening end directly attached to said second lateral flange by means of a second fastener;

a tightening device affixed to said second band and facilitating an adjustment of a length of said one linkage by removably retaining a portion of said first band against movement relative to said second band;

an abutment on said first band for preventing separation of said first band from said tightening device, said tightening device being positioned between said fastening end of said first band and said abutment;

said abutment comprising a pair of lateral teeth, extending rearwardly from said longitudinally tapered width of said free end of said first band.

17. A binding to retain a boot on a gliding or rolling apparatus, said binding comprising:

a base for supporting the boot, said base including a surface extending along a plane;

a first lateral flange, a second lateral flange transversely spaced from said first lateral flange, said first and second lateral flanges extending upwardly relative to said surface of said base;

at least one linkage connecting said first lateral flange to said second lateral flange, said linkage comprising:

a first band extending from a fastening end to a free end, a first fastener attaching said fastening end of said first band to said first lateral flange;

a second band extending from a fastening end to a free end, a second fastener attaching said fastening end of said second band to said second lateral flange;

a tightening device attached to said second band, said tightening device facilitating an adjustment of a length of said linkage by removably retaining a portion of said first band;

a common median plane of the linkage extends from said fastening end of said first band to said fastening end of said second band;

an abutment fixed to said first band proximate said free end of said first band, so as to be located on an opposite side of the tightening device with respect to said fastening end of said first band, thus preventing a separation of said first band and said tightening device;

said linkage being movable relative to said first and second lateral flanges to a boot removal/insertion position, said linkage extending along a plane positioned at substantially 0° relative to said plane of said surface of said base in said boot removal/insertion position.

18. A binding according to claim 17, wherein:

said first and second bands of said linkage extend longitudinally along a common plane, said plane intersecting said first and second fasteners.

19. A binding to retain a boot on a gliding or rolling apparatus, said binding comprising:

a base for supporting the boot, said base including an upper surface extending along a plane;

a first lateral flange, a second lateral flange transversely spaced from said first lateral flange, said first and second lateral flanges extending upwardly relative to said surface of said base;

at least one linkage connecting said first lateral flange to said second lateral flange, said linkage comprising:

a first band extending from one fastening end to a free end, a first fastener attaching said fastening end of said first band to said first lateral flange;

a tightening device attached to said second lateral flange, said tightening device facilitating an adjustment of a length of said linkage by removably retaining a portion of said first band;

at least one linkage of said at least one linkage being movable relative to said first and second lateral flanges to a boot removal/insertion position extending along a plane positioned at substantially 0° relative to said plane of said base.

20. A binding to retain a boot on a gliding or rolling apparatus, said binding comprising:

a base for supporting the boot, said base including an upper surface extending along a plane;

a first lateral flange, a second lateral flange transversely spaced from said first lateral flange, said first and second lateral flanges extending upwardly relative to said surface of said base;

a front linkage and a rear linkage, each of said front and rear linkages extending from said first lateral flange to said second lateral flange;

at least one of said front and rear linkages comprising:

a first band extending from a fastening end to a free end, a first fastener attaching said fastening end of said first band to said first lateral flange;

a second band extending from a fastening end to a free end, a second fastener attaching said fastening end of said second band to said second lateral flange;

a tightening device attached to said second band, said tightening device facilitating an adjustment of a length of said linkage between said first and second lateral flanges by engagement with an abutment of said first band as said first band is superimposed with a portion of said second band;

at least one of said front and rear linkages being movable relative to said first and second lateral flanges forwardly from a boot retention position to a boot removal/insertion position, while said abutment is engaged by said tightening device, said one of said front and rear linkages being unrestrained neither by said base nor by either of said first and second flanges in said boot removal/insertion position.

21. A binding according to claim 20, wherein:

said abutment of said first band comprises one of a series of teeth of said first band;

said tightening device comprises a pawl selectively manipulable into and out of abutting engagement with a tooth of said series of teeth of said first band.

22. A binding according to claim 20, wherein:

said tightening device comprises a bridge and a pair of laterally opposed upstanding wings attached to said second band, a passage having a width between said wings;

said abutment of said first band comprises an enlargement proximate the free end of said first band, said abutment having a width larger than said width of the passage to prevent withdrawal of said first band from said passage.

* * * * *